US008764914B2

(12) United States Patent
Gunsalus et al.

(10) Patent No.: US 8,764,914 B2
(45) Date of Patent: Jul. 1, 2014

(54) AQUEOUS QUENCHING MEDIA AND USE THEREOF IN QUENCHING METAL SUBSTRATES

(75) Inventors: Laura Gunsalus, Gilbertsville, PA (US); Joseph F. Warchol, Norristown, PA (US)

(73) Assignee: Houghton Technical Corp., Wilmington, DE (US)

( * ) Notice: Subject to any disclaimer, the term of this patent is extended or adjusted under 35 U.S.C. 154(b) by 0 days.

(21) Appl. No.: 12/981,589

(22) Filed: Dec. 30, 2010

(65) Prior Publication Data

US 2011/0094638 A1 Apr. 28, 2011

Related U.S. Application Data

(63) Continuation of application No. 11/870,457, filed on Oct. 11, 2007, now abandoned.

(51) Int. Cl.
*C21D 1/60* (2006.01)
*C21D 1/56* (2006.01)

(52) U.S. Cl.
CPC ... *C21D 1/60* (2013.01); *C21D 1/56* (2013.01)
USPC ..... 148/28; 148/637; 148/713; 568/46; 568/14; 568/616; 568/618; 568/624

(58) Field of Classification Search
CPC ..... C21D 1/60
USPC ..... 148/28
See application file for complete search history.

(56) References Cited

U.S. PATENT DOCUMENTS

| | | | |
|---|---|---|---|
| 3,220,893 | A | 11/1965 | Blackwood |
| 3,290,274 | A | 12/1966 | Latwack |
| 3,902,929 | A | 9/1975 | Meszaros |
| 4,087,290 | A | 5/1978 | Kopietz |
| 4,381,205 | A | 4/1983 | Warchol |
| 4,404,044 | A | 9/1983 | Warchol |
| 4,486,246 | A | 12/1984 | Warchol |
| 4,528,044 | A | 7/1985 | Warchol |
| 4,826,545 | A | 5/1989 | Foreman |
| RE34,119 | E | 11/1992 | Foreman |
| 5,908,886 | A | 6/1999 | Uchida |
| 6,103,820 | A | 8/2000 | Blankenburg |
| 2007/0154438 | A1 | 7/2007 | Chrisstoffels |

OTHER PUBLICATIONS

"Houghton on Quenching", Houghton Catalog (1943).

"Versatile Specialty Polymers for Technical Applications" BASF, Luvitec, 1-23 (2001).

Office Action issued in parent U.S. Appl. No. 11/870,457 and dated Sep. 1, 2010.

"Polyvinylpyrrolidones (PVP) for Metal Quenching", BASF Aktiengesellschaft, Ludwigshafen, Germany, Oct. 2007, obtained from the Internet at URL: http://www.luvitec.com/portal/load/fid539464/BASF (Oct. 2007).

Supplementary European Search Report dated Feb. 3, 2014 issued in related European Patent Application No. 08746198.7.

English translation of an Office Action dated Aug. 31, 2012 issued in related Chinese Patent Application No. 200880117665.3.

*Primary Examiner* — Jessee Roe

*Assistant Examiner* — Christopher Kessler

(74) *Attorney, Agent, or Firm* — Howson & Howson LLP

(57) ABSTRACT

Aqueous media for quenching metal substrates are provided and contain (i) a polyvinylpyrrolidone/polyvinylcaprolactam copolymer and (ii) one or more of a second polymer, which is selected from (a) a substituted oxazoline polymer; (b) a poly (oxyethylene-oxyalkylene) glycol; or (c) a polyvinylpyrrolidone polymer. The quenching bath provides reduced cooling rates through the martensite temperature ranges. Also provided are processes for quenching metal substrates using these quenching media.

13 Claims, No Drawings

AQUEOUS QUENCHING MEDIA AND USE THEREOF IN QUENCHING METAL SUBSTRATES

CROSS-REFERENCE TO RELATED APPLICATIONS

This application is a continuation of U.S. patent application Ser. No. 11/870,457, filed Oct. 11, 2007, now abandoned, which is hereby incorporated by reference.

BACKGROUND OF THE INVENTION

This invention relates to aqueous quenching media and processes using the same for quenching metal substrates.

Various methods of heat treating metal substrates are known and include heating a metal substrate to an elevated temperature and then cooling. The cooling step, which is known in the art as "quenching", typically is performed rapidly and is accomplished by immersing the hot metal substrate in a liquid quenching medium, i.e. a quenching bath, which typically is water or oil.

When the quenching medium is water alone, very rapid cooling of the metal substrate occurs. Rapid cooling is not suitable for many types of steel, since it tends to produce excessive strain which warps and cracks the steel. When the quenching medium is a hydrocarbon oil, a slower rate of cooling occurs. This can impart certain desirable physical properties in the metal substrate, including ductility in steel. Even though the slower cooling rate provided by oil quenching prevents or reduces excessive strain in the metal substrate, it often has the undesirable side-effect of preventing the metal substrate from adequately hardening.

A variety of aqueous media is available for quenching metal substrates and may include one or more of a polymer. For example, U.S. Pat. No. 3,220,893 discusses a quenching medium containing an oxyalkylene polymer having oxyethylene and higher oxyalkylene groups which form a desirable covering over the metal substrate surface during quenching. The polymer layer that coats the metal permits relatively short quenching times, thereby resulting in minimum internal stress of the metal substrate, minimum distortion of the metal substrate, and imparts uniform hardenability of the metal substrate.

U.S. Pat. Nos. 3,902,929, 4,826,545, and RE 34119 discuss aqueous quenching media containing a polyvinylpyrrolidone and U.S. Pat. No. 4,087,290 discusses an aqueous quenching medium containing a water-soluble polyacrylate, such as a sodium polyacrylate, which forms a vapor blanket about the metal substrate during the quenching operation.

Typically, aqueous polymer-based quenching media contain large amounts of polymer, e.g., 10 to 15% by weight, and "drag out" occurs during quenching in which the polymer coating that initially forms around in the metal substrate is removed. When drag out occurs, the viscosity of the quenching medium changes due to presence of solid polymer, thereby requiring an additional step of washing the quenched metal substrate to remove any of the solid polymer present on the metal substrate.

What is needed in the art are quenching media which will cool a heated metal substrate at a rate similar to oil-based quenching media at a rate that is between oil and water, while achieving the greatest degree of hardness without warping or cracking the metal substrate.

SUMMARY OF THE INVENTION

In one aspect, aqueous quenching media are provided and contain a non-ionic, water-soluble or water-dispersible polyvinylpyrrolidone/polyvinylcaprolactam copolymer; and a non-ionic, water-soluble or water-dispersible polymer including one or more of (a) a substituted oxazoline polymer; (b) a poly(oxyethyleneoxyalkylene) glycol polymer; or (c) a polyvinylpyrrolidone polymer In another aspect, aqueous quenching media for heat-treating metal substrates are provided and contain (i) a nonionic, water-soluble or water-dispersible substituted vinylpyrrolidone/vinylcaprolactam copolymer of Formula I, wherein R, n, and m are defined herein:

(I)

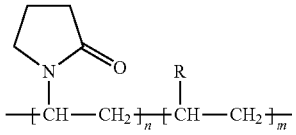

(ii) one or more polymers selected from among (a) a nonionic, water soluble or water dispersible substituted oxazoline polymer having Formula II, wherein $R^1$ and p are defined herein:

(II)

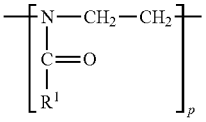

(b) a polyoxyethylene/polyoxyalkylene polymer having Formula III, wherein $R^2$, x, and y are defined herein:

(III)

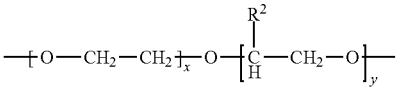

or (c) a vinylpyrrolidone polymer having Formula IV, wherein z is defined herein.

(IV)

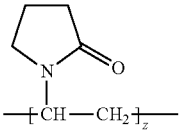

In a further aspect, processes for quenching heated metal substrates are provided and include quenching the heated metal substrate with an aqueous quenching medium containing a non-ionic, water-soluble or water-dispersible polyvinylpyrrolidone/polyvinylcaprolactam copolymer; and a non-ionic, water-soluble or water-dispersible polymer including one or more of (a) a substituted oxazoline polymer; (b) a poly(oxyethyleneoxyalkylene) glycol polymer; or (c) a polyvinylpyrrolidone polymer.

In yet a further aspect, concentrates for preparing aqueous quenching media useful in the heat treatment of metal substrates are provided and contain at least about 5% by weight of a mixture of the aqueous quenching medium.

Other aspects and advantages of the invention will be readily apparent from the following detailed description of the invention.

DETAILED DESCRIPTION OF THE INVENTION

The invention provides aqueous quenching media and processes for treating metal substrates using these aqueous quenching media. The inventors found that when a metal substrate is heated to an elevated temperature, the aqueous quenching media described herein are effective in quenching the metal substrate without warping or cracking the metal substrate. These aqueous quenching media are also effective in slowly cooling the metal substrate. The aqueous quenching media also exhibit a relatively short vapor phase and an extended convection stage which is more pronounced at higher temperatures. Further, the used aqueous quenching media require less wastewater treatment and are more environmentally friendly. Therefore, the aqueous quenching media described herein find use in industries, such as automotive, aerospace, bearing industries, gear industries, and industries involving the controlled heating and cooling of metal for the purpose of obtaining specific properties, including industries whereby aqueous quenching media cannot be utilized or are not effective.

Definitions

The processes and compositions described herein are therefore useful for quenching heated metal substrate. The term "metal substrate" as used herein refers to any commercial metal substrate that can be heated and then quenched. In one embodiment, the metal substrate contains only one metal. In another embodiment, the metal substrate contains more than one metal, i.e., a metal alloy. For example, the metal substrate may contain one or more of iron, manganese, copper, silicon, sulfur, phosphorus, aluminum, chromium, cobalt, columbium, molybdenum, nickel, titanium, tungsten, vanadium, zirconium, among others. Specific examples of metals that can be treated with the compositions described herein include those described in "The Heat Treater's Guide", American Society for Metals, 1982, which is hereby incorporated by reference.

The term "alkyl" is used herein to refer to both straight- and branched-chain saturated aliphatic hydrocarbon groups. In one embodiment, an alkyl group has 1 to about 10 carbon atoms (i.e., $C_1$, $C_2$, $C_3$, $C_4$, $C_5$ $C_6$, $C_7$, $C_8$, $C_9$, or $C_{10}$). In another embodiment, an alkyl group has 4 to about 10 carbon atoms (i.e., $C_4$, $C_5$, $C_6$, $C_7$, $C_8$, $C_9$, or $C_{10}$). In a further embodiment, an alkyl group has 5 to about 10 carbon atoms (i.e., $C_5$, $C_6$, $C_7$, $C_8$, $C_9$, or $C_{10}$).

The term "cycloalkyl" is used herein to refer to cyclic, saturated aliphatic hydrocarbon groups. In one embodiment, a cycloalkyl group has 4 to about 10 carbon atoms (i.e., $C_4$, $C_5$, $C_6$, $C_7$, $C_8$, $C_9$, or $C_{10}$). In another embodiment, a cycloalkyl group has 5 to about 10 carbon atoms (i.e., $C_5$, $C_6$, $C_7$, $C_8$, $C_9$, or $C_{10}$).

The term "alkenyl" is used herein to refer to both straight- and branched-chain alkyl groups having one or more carbon-carbon double bonds. In one embodiment, an alkenyl group has 2 to about 10 carbon atoms (i.e., $C_2$, $C_3$, $C_4$, $C_5$ $C_6$, $C_7$, $C_8$, $C_9$, or $C_{10}$). In another embodiment, an alkenyl group has 4 to about 10 carbon atoms (i.e., $C_4$, $C_5$, $C_6$, $C_7$, $C_8$, $C_9$, or $C_{10}$). In a further embodiment, an alkenyl group has 5 to about 10 carbon atoms (i.e., $C_5$, $C_6$, $C_7$, $C_8$, $C_9$, or $C_{10}$). In another embodiment, an alkenyl group has 1 or 2 carbon-carbon double bonds.

The term "cycloalkenyl" is used herein to refer to cyclic, aliphatic hydrocarbon groups containing one or more carbon-carbon double bond. In one embodiment, a cycloalkenyl group has 4 to about 10 carbon atoms (i.e., $C_4$, $C_5$, $C_6$, $C_7$, $C_8$, $C_9$, or $C_{10}$). In another embodiment, a cycloalkenyl group has 5 to about 10 carbon atoms (i.e., $C_5$, $C_6$, $C_7$, $C_8$, $C_9$, or $C_{10}$).

The term "alkynyl" is used herein to refer to both straight- and branched-chain alkyl groups having one or more carbon-carbon triple bonds. In one embodiment, an alkynyl group has 2 to about 10 carbon atoms (i.e., $C_2$, $C_3$, $C_4$, $C_5$ $C_6$, $C_7$, $C_8$, $C_9$, or $C_{10}$). In another embodiment, an alkynyl group has 4 to about 10 carbon atoms (i.e., $C_4$, $C_5$, $C_6$, $C_7$, $C_8$, $C_9$, or $C_{10}$). In a further embodiment, an alkynyl group has 5 to about 10 carbon atoms (i.e., $C_5$, $C_6$, $C_7$, $C_8$, $C_9$, or $C_{10}$). In another embodiment, an alkynyl group contains 1 or 2 carbon-carbon triple bonds.

The term "cycloalkynyl" is used herein to refer to cyclic, aliphatic hydrocarbon groups containing one or more carbon-carbon triple bond. In one embodiment, a cycloalkynyl group has 8 to about 14 carbon atoms (i.e., $C_8$, $C_9$, $C_{10}$, $C_{11}$, $C_{12}$, $C_{13}$, or $C_{14}$). In another embodiment, a cycloalkynyl group has 8 to about 10 carbon atoms (i.e., $C_8$, $C_9$, or $C_{10}$).

The terms "substituted alkyl", "substituted alkenyl", "substituted alkynyl", "substituted cycloalkyl", "substituted cycloalkenyl", and "substituted cycloalkynyl" refer to alkyl, alkenyl, alkynyl, cycloalkyl, cycloalkenyl, and cycloalkynyl groups, respectively, having one or more substituents including, without limitation, hydrogen, halogen, CN, OH, $NO_2$, amino, aryl, heterocyclic, heteroaryl, alkoxy, aryloxy, alkylcarbonyl, alkylcarboxy, amino, and arylthio.

The term "alkylcarbonyl" as used herein refers to the C(O)(alkyl) group, where the point of attachment is through the carbon-atom of the carbonyl moiety and the alkyl group can be substituted as noted above.

The term "alkylcarboxy" as used herein refers to the C(O)O(alkyl) group, where the point of attachment is through the carbon-atom of the carboxy moiety and the alkyl group can be substituted as noted above.

The term "alkylamino" and "aminoalkyl" as used herein are interchangeable and refer to both secondary and tertiary amines where the point of attachment is through the nitrogen-atom and the alkyl groups can be substituted as noted above. The alkyl groups can be the same or different.

The term "halogen" as used herein refers to Cl, Br, F, or I groups.

The term "aryl" as used herein refers to an aromatic, carbocyclic system, e.g., of about 6 to 14 carbon atoms, which can include a single ring or multiple aromatic rings fused or linked together where at least one part of the fused or linked rings forms the conjugated aromatic system. The aryl groups include, but are not limited to, phenyl, naphthyl, biphenyl, anthryl, tetrahydronaphthyl, phenanthryl, indene, benzonaphthyl, and fluorenyl.

The term "substituted aryl" refers to an aryl group which is substituted with one or more substituents including halogen, CN, OH, $NO_2$, amino, alkyl, cycloalkyl, alkenyl, alkynyl, $C_1$ to $C_3$ perfluoroalkyl, $C_1$ to $C_3$ perfluoroalkoxy, aryloxy, alkoxy including —O—($C_1$ to $C_{10}$ alkyl) or —O—($C_1$ to $C_{10}$ substituted alkyl), alkylcarbonyl including —CO—($C_1$ to $C_{10}$ alkyl) or —CO—($C_1$ to $C_{10}$ substituted alkyl), alkylcarboxy including —COO—($C_1$ to $C_{10}$ alkyl) or —COO—($C_1$ to $C_{10}$ substituted alkyl), —C($NH_2$)═N—OH, —$SO_2$—($C_1$ to $C_{10}$ alkyl), —$SO_2$—($C_1$ to $C_{10}$ substituted alkyl), —O—$CH_2$-aryl, alkylamino, arylthio, aryl, or heteroaryl, which groups can be substituted. Desirably, a substituted aryl group is substituted with 1 to about 4 substituents.

The term "heterocycle" or "heterocyclic" as used herein can be used interchangeably to refer to a stable, saturated or partially unsaturated 3- to 9-membered monocyclic or multicyclic heterocyclic ring. The heterocyclic ring has in its backbone carbon atoms and one or more heteroatoms including nitrogen, oxygen, and sulfur atoms. In one embodiment, the heterocyclic ring has 1 to about 4 heteroatoms in the backbone of the ring. When the heterocyclic ring contains nitrogen or sulfur atoms in the backbone of the ring, the nitrogen or sulfur atoms can be oxidized. The term "heterocycle" or "heterocyclic" also refers to multicyclic rings in which a heterocyclic ring is fused to an aryl ring of about 6 to about 14 carbon atoms. The heterocyclic ring can be attached to the aryl ring through a heteroatom or carbon atom provided the resultant heterocyclic ring structure is chemically stable. In one embodiment, the heterocyclic ring includes multicyclic systems having 1 to 5 rings.

A variety of heterocyclic groups are known in the art and include, without limitation, oxygen-containing rings, nitrogen-containing rings, sulfur-containing rings, mixed heteroatom-containing rings, fused heteroatom containing rings, and combinations thereof. Examples of heterocyclic groups include, without limitation, tetrahydrofuranyl, piperidinyl, 2-oxopiperidinyl, pyrrolidinyl, morpholinyl, thiamorpholinyl, thiamorpholinyl sulfoxide, pyranyl, pyronyl, dioxinyl, piperazinyl, dithiolyl, oxathiolyl, dioxazolyl, oxathiazolyl, oxazinyl, oxathiazinyl, benzopyranyl, benzoxazinyl and xanthenyl.

The term "heteroaryl" as used herein refers to a stable, aromatic 5- to 14-membered monocyclic or multicyclic heteroatom-containing ring. The heteroaryl ring has in its backbone carbon atoms and one or more heteroatoms including nitrogen, oxygen, and sulfur atoms. In one embodiment, the heteroaryl ring contains 1 to about 4 heteroatoms in the backbone of the ring. When the heteroaryl ring contains nitrogen or sulfur atoms in the backbone of the ring, the nitrogen or sulfur atoms can be oxidized. The term "heteroaryl" also refers to multicyclic rings in which a heteroaryl ring is fused to an aryl ring. The heteroaryl ring can be attached to the aryl ring through a heteroatom or carbon atom provided the resultant heterocyclic ring structure is chemically stable. In one embodiment, the heteroaryl ring includes multicyclic systems having 1 to 5 rings.

A variety of heteroaryl groups are known in the art and include, without limitation, oxygen-containing rings, nitrogen-containing rings, sulfur-containing rings, mixed heteroatom-containing rings, fused heteroatom containing rings, and combinations thereof. Examples of heteroaryl groups include, without limitation, furyl, pyrrolyl, pyrazolyl, imidazolyl, triazolyl, pyridyl, pyridazinyl, pyrimidinyl, pyrazinyl, triazinyl, azepinyl, thienyl, dithiolyl, oxathiolyl, oxazolyl, thiazolyl, oxadiazolyl, oxatriazolyl, oxepinyl, thiepinyl, diazepinyl, benzofuranyl, thionapthene, indolyl, benzazolyl, purindinyl, pyranopyrrolyl, isoindazolyl, indoxazinyl, benzoxazolyl, quinolinyl, isoquinolinyl, benzodiazonyl, napthylridinyl, benzothienyl, pyridopyridinyl, acridinyl, carbazolyl, and purinyl rings.

The term "substituted heterocycle" and "substituted heteroaryl" as used herein refers to a heterocycle or heteroaryl group having one or more substituents including halogen, CN, OH, $NO_2$, amino, alkyl, cycloalkyl, alkenyl, alkynyl, $C_1$ to $C_3$ perfluoroalkyl, $C_1$ to $C_3$ perfluoroalkoxy, aryloxy, alkoxy including —O—($C_1$ to $C_{10}$ alkyl) or —O—($C_1$ to $C_{10}$ substituted alkyl), alkylcarbonyl including —CO—($C_1$ to $C_{10}$ alkyl) or —CO—($C_1$ to $C_{10}$ substituted alkyl), alkylcarboxy including —COO—($C_1$ to $C_{10}$ alkyl) or —COO—($C_1$ to $C_{10}$ substituted alkyl), —C($NH_2$)=N—OH, —$SO_2$—($C_1$ to $C_{10}$ alkyl), —$SO_2$—($C_1$ to $C_{10}$ substituted alkyl), —O—$CH_2$-aryl, alkylamino, arylthio, aryl, or heteroaryl, which groups may be optionally substituted. A substituted heterocycle or heteroaryl group may have 1, 2, 3, or 4 substituents.

The term "thioaryl" as used herein refers to the S(aryl) group, where the point of attachment is through the sulfur-atom and the aryl group can be substituted as noted above. The term "alkoxy" as used herein refers to the O(alkyl) group, where the point of attachment is through the oxygen-atom and the alkyl group can be substituted as noted above. The term "oxyaryl" as used herein refers to the O(aryl) group, where the point of attachment is through the oxygen-atom and the aryl group can be substituted as noted above. The term "thioalkyl" as used herein refers to the S(alkyl) group, where the point of attachment is through the sulfur-atom and the alkyl group can be substituted as noted above.

The Aqueous Quenching Medium

The aqueous quenching medium described herein contains at least two components, i.e., component (i) and component (ii). The inventors found that the aqueous quenching medium is effective in quenching metal substrates, without any significant increase in cooling rate, when the amount of component (ii) is greater than the amount of component (i). Desirably, the two components are present in the quenching medium in an amount that is effective to reduce the cooling rate of the quenching medium when applied to a metal substrate, i.e., the aqueous quenching medium contains an effective cooling rate reducing amount of (i) and (ii). In one example, the ratio of component (i) to component (ii) is about 90:10 to about 10:90. In a further example, the ratio of component (i) to component (ii) is about 80:20 to about 20:80. In another example, the ratio of component (i) to component (ii) is about 75:25 to about 25:75. In another example, the ratio of component (i) to component (ii) is about 60:40 to about 40:60. In a further example, the ratio of component (i) to component (ii) is about 75:25.

A. The First Component (i)

The first component, i.e., component (i), of the aqueous quenching medium described herein is a non-ionic, water-soluble or water-dispersible polyvinylpyrrolidone (PVP)/polyvinylcaprolactam (PVC) copolymer. The term "water-dispersible" as used herein refers to a compound that does not dissolve in water, but combines with water without clumping in the water. The term "water-soluble" as used herein refers to a compound that substantially dissolves in water. Desirably, the term "water-soluble" refers to a compound has 100% dissolution in water.

In one embodiment, the PVP/PVC copolymer is of formula I:

(I)

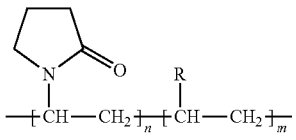

wherein, R is an organic radical which does not significantly alter the nonionic, water-solubility, and water-dispersibility characteristic of the PVP/PVC copolymer and n and m are, independently, integers. Desirably, n is about 45 to about 18,000, and fractional integers therebetween. In one embodiment, n is 45, 50, 100, 500, 1,000, 1,500, 2,000, 2,500, 3,000, 3,500, 4,000, 4,500, 5,000, 5,500, 6,000, 6,500, 7,000, 7,500, 8,000, 8,500, 9,000, 9,500, 10,000, 10,500, 11,000, 11,500, 12,000, 12,500, 13,000, 13,500, 14,000, 14,500, 15,000, 15,500, 16,000, 16,500, 17,000, 17,500, or 18,000. In another embodiment, n is about 1,000 to about 17,000. In a further embodiment, n is about 3,000 to about 15,000. In yet another embodiment, n is about 5,000 to about 13,000. In still a further embodiment, n is about 7,000 to about 11,000. In another embodiment, n is about 9,000 to about 10,000. Desirably, m is about 36 to about 14,500. In one embodiment, m is 36, 50, 100, 500, 1,000, 1,500, 2,000, 2,500, 3,000, 3,500, 4,000, 4,500, 5,000, 5,500, 6,000, 6,500, 7,000, 7,500, 8,000, 8,500, 9,000, 9,500, 10,000, 10,500, 11,000, 11,500, 12,000, 12,500, 13,000, 13,500, 14,000, or 14,500. In another embodiment, m is about 1,000 to about 13,000. In a further embodiment, m is about 3,000 to about 11,000. In yet another embodiment, m is about 5,000 to about 9,000. In still a further embodiment, m is about 7,000 to about 8,000.

The term "organic radical" as used herein refers to an organic moiety that contains at least carbon and hydrogen atoms. The R group in each unit may be the same or may be different. In one example, R is alkyl, alkenyl, or alkynyl, optionally containing one or more heteroatoms in the backbone of the alkyl, alkenyl, or alkynyl group. In another example, R is OH, $NH_2$, SH, $C_4$ to $C_{10}$ alkyl, substituted $C_4$ to $C_{10}$ alkyl, $C_4$ to $C_{10}$ cycloalkyl, substituted $C_4$ to $C_{10}$ cycloalkyl, $C_4$ to $C_{10}$ cycloalkenyl, substituted $C_4$ to $C_{10}$ cycloalkenyl, $C_4$ to $C_{10}$ cycloalkynyl, substituted $C_4$ to $C_{10}$ cycloalkynyl, $C_4$ to $C_{10}$ alkoxy, substituted $C_4$ to $C_{10}$ alkoxy, $C_4$ to $C_{10}$ aminoalkyl, substituted $C_4$ to $C_{10}$ aminoalkyl, $C_4$ to $C_{10}$ thioalkyl, $C_4$ to $C_{10}$ substituted thioalkyl, thioaryl, substituted thioaryl, oxyaryl, oxy(substituted aryl), alkylcarbonyl, substituted alkylcarbonyl, alkylcarboxy, or substituted alkylcarboxy.

The PVP/PVC copolymer has a molecular weight of about 5,000 to about 2,000,000. Desirably, the molecular weight of the PVP/PVC copolymer is about 50,000 to about 1,000,000. In another example, the molecular weight of the PVP/PVC copolymer is about 50,000 to about 390,000. In a further example, the molecular weight of the PVP/PVC copolymer is about 100,000 to about 200,000. In still another example, the molecular weight of the PVP/PVC copolymer is about 400,000. The PVP/PVC copolymer is also characterized by a K-value of at least about 60, 61, 62, 63, 64, 65, 66, 67, 68, 69 to about 70. The term "K-value" as used herein is commonly utilized in the art and refers to a function of molecular weight as described in "Performance & Industrial Chemicals Reference Guide", International Specialty Products, page 20, 2005, which is hereby incorporated by reference. In one example, the K-value of the PVP/PVC copolymer is about 65.

The PVP/PVC copolymer can have varying ratios of n and m. In one example, the copolymer contains about 50 to about 75% of n and about 25 to about 50% of m, provided that the combination of n and m is 100%. In a further example, the PVP/PVC copolymer contains about 75% of n and about 25% of m. In another example, the PVP/PVC copolymer contains about 66.6% of n and about 33.3% of m. In yet a further example, the PVP/PVC copolymer contains about 50% of n and about 50% of m.

B. The Second Component (ii)

The second component of the aqueous quenching medium is a non-ionic, water-soluble or water-dispersible polymer. Desirably, the second component is a substituted oxazoline polymer, a poly(oxyethyleneoxyalkylene) glycol polymer, or a polyvinylpyrrolidone polymer.

In one embodiment, the second component of the aqueous quenching medium is a substituted oxazoline polymer of formula II:

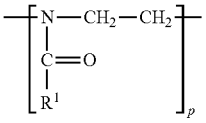

(II)

wherein, $R^1$ is an organic radical which does not significantly alter the nonionic and water soluble or water dispersible characteristics of the substituted oxazoline polymer and p is an integer. In one example, p is an integer of from 25 to 12,000. In still other embodiments, p is at least 50; 100; 250; 400; 600; 850; 1000; 2000; 3000; 4000; 5000; 6000; 7000; 8000; 9000; 10,000; 11,000; 11,900 or an integer therebetween. $R^1$ in each unit may be the same or different. In one example, $R^1$ is aryl, aryl substituted with halogen, $C_1$ to $C_7$ alkyl, or $C_1$ to $C_7$ alkyl substituted with halogen. In a further example, $R^1$ is phenyl or phenyl substituted with halogen. In another example, $R^1$ is $C_1$ to $C_6$ alkyl in at least about 50% of the units.

The molecular weight of the oxazoline polymer typically is about 5,000 to about 1,000,000. In another example, the molecular weight of the oxazoline polymer at least about 25,000; 50,000; 75,000; 100,000; 150,000; 200,000; 250,000; 300,000; 350,000; 400,000; 450,000; to about 500,000, or any amount therebetween. In a further example, the molecular weight of the oxazoline polymer is about 200,000 to about 500,000.

In another embodiment, the second component is a polyoxyethylene/polyoxyalkylene polymer of formula III:

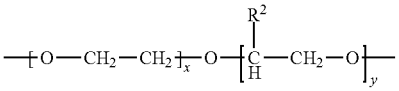

(III)

wherein, $R^2$ is an a chemical moiety that maintains the water solubility of the polyoxyethylene/polyoxyalkylene polymer and x and y are integers, provided that the polyoxyethylene/polyoxyalkylene polymer is water-soluble and the polyoxyethylene/polyoxyalkylene polymer has a molecular weight of at least about 1,000; 25,000; 50,000; 75,000; 100,000; 150,000; 200,000; 250,000; 300,000; 350,000; 400,000; 450,000; to about 500,000, or any amount therebetween. Desirably, $R^2$ maintains the water solubility of the polyoxyethylene/polyoxyalkylene polymer at about 70 to about 180° F., including temperatures of at least 80, 90, 100, 110, 120, 130, 140, 150, 160, 170, or 180, and values therebetween. In one example, $R^2$ is an alkyl, substituted alkyl, alkenyl, substituted alkenyl, alkynyl, or substituted alkynyl. In another example, $R^2$ is methyl or ethyl.

The units, i.e., x and y, of the polyoxyethylene/polyoxyalkylene polymer may be the same or may differ and may have varying amounts therein. For example x may be larger than y or y may be larger than x. Desirably, x is about 10 to about 5,000. In one embodiment, x is about 10, 50, 100, 200, 250, 500, 750, 1,000, 1,500, 2,000, 2,500, 3,000, 3,500, 4,000, 4,500, or 5,000, or values therebetween. In another embodiment, x is about 100 to about 4,000. In a further embodiment, x is about 500 to about 3,500. In yet another embodiment, x is about 500 to about 3,500. In still a further embodiment, x is about 750 to about 3,000. In another embodiment, x is about 1,000 to about 2,500. Desirably, y is about 10 to about 5,000. In one embodiment, y is about 10, 50, 100, 200, 250, 500, 750, 1,000, 1,500, 2,000, 2,500, 3,000, 3,500, 4,000, 4,500, or 5,000, or values therebetween. In another embodiment, y is about 100 to about 4,000. In a further embodiment, y is about 500 to about 3,500. In yet another embodiment, y is about 500 to about 3,500. In still a further embodiment, y is about 750 to about 3,000. In another embodiment, y is about 1,000 to about 2,500.

In one example, the molecular weight of the polyoxyethylene/polyoxyalkylene polymer is at least about 1,000; 12,000; 15,000; 25,000; 30,000; 50,000; 75,000; 100,000; 150,000; 200,000; 250,000; 300,000; 350,000; 400,000; 450,000; to about 500,000, or any amount therebetween. In another example, the molecular weight of the polyoxyethylene/polyoxyalkylene polymer is about 5,000 to about 100,000. In a further example, the molecular weight of the polyoxyethylene/polyoxyalkylene polymer is about 300,000.

In a further embodiment, the second component is a vinylpyrrolidone polymer of formula IV:

(IV)

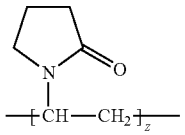

wherein, z is an integer. Desirably, z is about 40 to about 32,000. In one embodiment, z is about 100, 1,000, 2,000, 3,000, 4,000, 5,000, 6,000, 7,000, 8,000, 9,000, 10,000, 11,000, 12,000, 13,000, 14,000, 15,000, 16,000, 17,000, 18,000, 19,000, 20,000, 21,000, 22,000, 23,000, 24,000, 25,000, 26,000, 27,000, 28,000, 29,000, 30,000, 31,000, or 32,000, or values therebetween. In another embodiment, z is about 1,000 to about 30,000. In a further embodiment, z is about 3,000 to about 28,000. In still another embodiment, z is about 5,000 to about 26,000. In yet a further embodiment, z is about 7,000 to about 24,000. In a further embodiment, z is about 9,000 to about 22,000. In still a further embodiment, z is about 11,000 to about 20,000. In yet another embodiment, z is about 13,000 to about 18,000. In a further embodiment, z is about 15,000 to about 16,000.

Desirably, the vinylpyrrolidone polymer has a molecular weight of at least about 5,000; 50,000; 100,000; 250,000; 500,000; 750,000; 1,000,000; 1,500,000; 2,000,000; 2,500,000; 3,000,000 to about 3,500,000, including numbers therebetween. In one example, the vinylpyrrolidone polymer has a molecular weight of least about 5,000; 10,000; 20,000; 30,000; 40,000; 50,000; 60,000; 70,000; 80,000; 90,000 to about 1,000,000 or values therebetween. In another example, the vinylpyrrolidone polymer has a molecular weight of about 50,000 to about 360,000. In a further example, the vinylpyrrolidone polymer has a molecular weight of about 400,000 to 500,000. In yet another example, the vinylpyrrolidone polymer has a molecular weight of about 100,000 to about 200,000.

It is also desirable that the vinylpyrrolidone polymer have a K-value of about 26 to 130. In one example, the K-value is about 90. In still other embodiments, the K-value is at least 30, 40, 50, 60, 70, 80, 90, 100, 110, 120, or integers therebetween.

C. Additional Components of the Quenching Medium

The aqueous quenching medium may also contain one or more additional components, as identified below. The additional components typically are present in the medium at an excess over components (i) and (ii) described above. In one example, the additional components are present in the medium at a concentration of about 95 to about 99.95% and components (i) and (ii) described above are present in the medium at a concentration of about 0.05% to about 5% by weight. In another example, the additional components are present in the medium at a concentration of about 98.5% to about 99.95% by weight and components (i) and (ii) described above are present in the medium at a concentration of about 0.05% to about 1.5%.

In one embodiment, the additional components present in the aqueous quenching medium may include a carrier. In one example, the carrier is water. The carrier may be included in the quenching medium, thereby permitting use of the product by the customer without addition of further carrier. Alternatively, the carrier is present in the quenching medium in sufficient amounts to provide a stable solution for further dilution by the customer prior to use. The carrier may also be added by the customer to a concentrated quenching medium composition prior to use. However, more water made be added to the composition to ensure that the final quenching medium contains sufficient water for use by the customer.

The aqueous quenching medium may also contain one or more of a bacteriocidal agent or biocide, preservative, corrosion inhibitor such as sodium nitrite, ethanol amine or amine soaps, buffer, metal deactivator, dye, fragrance, caustic agent, wetting agent, sequestering agent, fungicide, and defoamer, among others. Desirably, the additional components include corrosion inhibitors and defoamers. These components may be present in the composition at about 0.05% to about 10% by weight. In one example, these components are present in the composition at about 0.05, 0.1, 0.5, 1, 1.5, 2, 2.5, 3, 3.5, 4, 4.5, 5, 5.5, 6, 6.5, 7, 7.5, 8, 8.5, 9, 9.5, or 10% by weight, or fractional percentages therebetween.

D. Specific Embodiments of Combinations of (I) and (Ii)

In one example, component (i) of the aqueous quenching medium is a PVP/PVC copolymer having a molecular weight of about 50,000 to about 1,000,000, component (ii) is an oxazoline polymer having a molecular weight of about 50,000 to about 500,000, and the concentration of components (i) and (ii) is about 0.05% to about 5% by weight. The aqueous quenching medium may also contain about 0.05% to about 10% by weight of additives, including, without limitation, corrosion inhibitors and defoamers.

In another example, component (i) of the aqueous quenching medium is a PVP/PVC copolymer having a molecular weight of about 100,000 to about 200,000, component (ii) is an oxazoline polymer having a molecular weight of about 200,000 to about 500,000, and the concentration of components (i) and (ii) is about 0.05% to about 1.5% by weight. The aqueous quenching medium may also contain about 0.05% to about 10% by weight of additives, including, without limitation, corrosion inhibitors and defoamers.

In a further example, component (i) of the aqueous quenching medium is a PVP/PVC copolymer having a molecular weight of about 50,000 to about 1,000,000, component (i) is a polyoxyethylene/polyoxyalkylene polymer having a molecular weight of about 1,000 to about 500,000, and the concentration of components (i) and (ii) is about 0.05% to 5% by weight. The aqueous quenching medium may also contain about 0.05% to about 10% by weight of additives, including, without limitation, corrosion inhibitors and defoamers.

In still another example, component (i) of the aqueous quenching medium is a PVP/PVC copolymer having a molecular weight of about 100,000 to about 200,000, component (ii) is polyoxyethylene/polyoxyalkylene polymer having a molecular weight of about 5,000 to about 100,000, and concentration of components (i) and (ii) is about 0.05% to about 1.5% by weight. The aqueous quenching medium may also contain about 0.05% to about 10% by weight of additives, including, without limitation, corrosion inhibitors and defoamers.

In yet a further example, component (i) of the aqueous quenching medium is a PVP/PVC copolymer having a molecular weight of about 50,000 to about 1,000,000, component (ii) is a vinylpyrrolidone polymer having a molecular weight of about 5,000 to about 1,000,000, and the concentration of components (i) and (ii) is about 0.05% to 5% by weight. The aqueous quenching medium may also contain about 0.05% to about 10% by weight of additives, including, without limitation, corrosion inhibitors and defoamers.

In another example, component (i) of the aqueous quenching medium is a PVP/PVC copolymer having a molecular weight of about 100,000 to about 200,000, component (ii) is a vinylpyrrolidone polymer having a molecular weight of about 5,000 to about 1,000,000, and the concentration of components (i) and (ii) is about 0.05% to about 1.5% by weight. The aqueous quenching medium may also contain about 0.05% to about 10% by weight of additives, including, without limitation, corrosion inhibitors and defoamers.

In one preferred embodiment, an aqueous quenching medium for heat-treating metal substrates is provided and contains a nonionic, water-soluble or water-dispersible substituted vinylpyrrolidone/vinylcaprolactam polymer of formula I, wherein, R is an organic radical which does not significantly alter the nonionic, water-solubility, and water-dispersibility characteristic of the vinylpyrrolidone/vinylcaprolactam polymer; n and m are independently integers, provided that the substituted vinylpyrrolidone/vinylcaprolactam polymer has a molecular weight of from about 5,000 to about 1,000,000 and a K-value of about 60 to about 70. The substituted vinylpyrrolidone/vinylcaprolactam copolymer has a vinylpyrrolidone component of about 10 to about 90 mol %, the substituted vinylpyrrolidone/vinylcaprolactam copolymer has a vinylcaprolactam component of about 90 to about 10 mol %, and the sum of said vinylpyrrolidone and vinylcaprolactam components is 100 mol %. The aqueous quenching medium also contains one or more polymers selected from among (a), (b), or (c). Polymer (a) is a nonionic, water soluble or water dispersible substituted oxazoline polymer having formula II, wherein, $R^1$ is an organic radical which does not significantly alter the nonionic and water soluble or water dispersible characteristics of the substituted oxazoline polymer; p is an integer, provided that the molecular weight of the oxazoline polymer is about 50,000 to about 1,000,000. Polymer (b) is a polyoxyethylene/polyoxyalkylene polymer having formula III, wherein, $R^2$ is an alkyl, substituted alkyl, alkenyl, substituted alkenyl, alkynyl, or substituted alkynyl; x and y are integers, provided that the polyoxyethylene/polyalkylene polymer is water-soluble and the has a molecular weight of about 1,000 to about 500,000. Polymer (c) is a vinylpyrrolidone polymer having formula IV, wherein, z is an integer, provided that the vinylpyrrolidone polymer has a molecular weight of about 5,000 to about 3,500,000 and a K-value of about 26 to 130.

E. Concentrates of the Quenching Medium

The invention also provides a concentrate which contains the first and second components described above. This concentrate may be utilized by those skilled in the art for preparing an aqueous quenching medium useful in the heat treatment of metal substrates. In one example, the concentrate contains water and at least about 5% by weight of components (i) and (ii) described above. In another example, the concentrate contains water and about 5% to 70% by weight of components (i) and (ii). In a further example, the concentrate contains about 5% to about 20% of components (i) and (ii) described above.

In one embodiment, a concentrate is provided and contains a vinylpyrrolidone/vinylcaprolactam copolymer having a molecular weight of about 50,000 to about 1,000,000 and an oxazoline polymer having a molecular weight of about 50,000 to about 500,000 wherein the concentration of the vinylpyrrolidone/vinylcaprolactam copolymer and the oxazoline polymer in the concentrate is about 5% to 70%.

In another embodiment, a concentrate is provided and contains a vinylpyrrolidone/vinylcaprolactam copolymer having a molecular weight of about 100,000 to about 200,000 and an oxazoline polymer having a molecular weight of about 200,000 to about 500,000, wherein the concentration of the vinylpyrrolidone/vinylcaprolactam copolymer and the oxazoline polymer in the concentrate is about 5% to about 20%.

In a further embodiment, a concentrate is provided and contains a vinylpyrrolidone/vinylcaprolactam copolymer having a molecular weight of about 50,000 to about 1,000,000 and a polyoxyethylene/polyoxyalkylene copolymer having a molecular weight of about 1,000 to about 500,000, wherein the concentration of the vinylpyrrolidone/vinylcaprolactam copolymer and the polyoxyethylene/polyoxyalkylene copolymer in the concentrate is about 5% to 70%.

In yet another embodiment, a concentrate is provided and contains a vinylpyrrolidone/vinylcaprolactam copolymer having a molecular weight of about 100,000 to about 200,000 and a polyoxyethylene/polyoxyalkylene copolymer having a molecular weight of about 5,000 to about 100,000, wherein the concentration of the vinylpyrrolidone/vinylcaprolactam copolymer and the polyoxyethylene/polyoxyalkylene copolymer in the concentrate is about 5% to about 20%.

In a further embodiment, a concentrate is provided and contains a vinylpyrrolidone/vinylcaprolactam copolymer having a molecular weight of about 50,000 to about 1,000,000 and a vinylpyrrolidone polymer having a molecular weight of about 5,000 to about 1,000,000, wherein the concentration of the vinylpyrrolidone/vinylcaprolactam copolymer and the vinylpyrrolidone polymer in the concentrate is about 5% to 70%.

In still a further embodiment, a concentrate is provided and contains a vinylpyrrolidone/vinylcaprolactam copolymer having a molecular weight of about 100,000 to about 200,000 and a vinylpyrrolidone polymer having a molecular weight of about 5,000 to about 1,000,000, wherein the concentration of the vinylpyrrolidone/vinylcaprolactam copolymer and the vinylpyrrolidone polymer is about 5% to about 20%.

In one example, a concentrate is provided and contains at least about 5% by weight of a mixture of (i) a nonionic, water-soluble or water-dispersible substituted vinylpyrrolidone/vinylcaprolactam polymer of formula I, wherein, R is an organic radical which does not significantly alter the nonionic, water-solubility, and water-dispersibility characteristic of the vinylpyrrolidone/vinylcaprolactam polymer, n and m are independently integers, provided that the vinylpyrrolidone/vinylcaprolactam polymer has a molecular weight of from about 5,000 to about 1,000,000 and a K-value of about 60 to about 70; and wherein the vinylpyrrolidone/vinylcaprolactam copolymer has a vinylpyrrolidone component of about 10 to about 90 mol %, the vinylpyrrolidone/vinylcaprolactam copolymer has a vinylcaprolactam component of about 90 to about 10 mol %, and the sum of the vinylpyrrolidone and vinylcaprolactam components is 100 mol %. The concentrate also contains one or more polymers selected from among (a), (b), or (c). Polymer (a) is a nonionic, water soluble or water dispersible substituted oxazoline polymer having formula II, wherein, $R^1$ is an organic radical which does not significantly alter the nonionic and water soluble or water dispersible characteristics of the substituted oxazoline polymer, p is an integer, provided that the molecular weight of the oxazoline polymer is about 50,000 to about 1,000,000. Polymer (b) is a polyoxyethylene/polyoxyalkylene polymer having formula III, wherein, $R^2$ is an alkyl, substituted alkyl, alkenyl, substituted alkenyl, alkynyl, or substituted alkynyl, x and y are integers, provided that the polyoxyethylene/polyoxyalkylene polymer is water-soluble and the polyoxyethylene/polyoxyalkylene polymer has a molecular weight of about 1,000 to about 500,000. Polymer (c) is a vinylpyrrolidone polymer having formula IV, wherein, z is an integer, provided that the vinylpyrrolidone polymer has a molecular weight of about 5,000 to about 3,500,000 and a K-value of about 26 to 130.

F. Examples

The following examples are illustrative only and are not intended to be a limitation on the present invention.

Example 1

Quenching Metal Substrates Using Aqueous Quenching Media

Fifteen aqueous quenching media were prepared:

(a) Quenching media 1-5 contained aqueous solutions of polyvinylpyrrolidone/polyvinylcaprolactam copolymer of Formula I above and/or a substituted oxazoline polymer of Formula II above;

(b) Quenching media 6-10 contained aqueous solutions of polyvinylpyrrolidone/polyvinylcaprolactam copolymer of Formula I above and/or a poly(oxyethylene-oxyalkylene) glycol of Formula III above; and (c) Quenching media 11-15 contained aqueous solutions of polyvinylpyrrolidone/polyvinylcaprolactam copolymer of Formula I and/or a polyvinylpyrrolidone polymer of Formula IV above. The sample concentrations are set forth in Table I.

In order to determine cooling times, the IVF Quenchotest (The Swedish Institute of Production Engineering Research) was utilized and included the IVF data acquisition/recording unit, test probe, probe handle and furnace. The test probe (600 mm in length and 12.5 mm diameter of the Inconel® 600 probe enclosing a type K thermocouple —NiCr/NiAl— with a diameter of 1.5 mm) complied with the specification for testing quenchants as established by the International Federation for the Heat Treatment of Materials (IFHT). The furnace thermostat controlled the power supplied to the furnace through diode rectification and was operated without a controlled atmosphere. The furnace temperature was adjusted to about 1625° F. (885° C.).

In each run, the metal substrate was heated to a temperature of about 1571° F. (855° C.) to about 1600° F. (870° C.) and then immersed in 1.0 kilograms of one of the fifteen (15) aqueous quenching media described above which were maintained at a temperature of about 100° F. (40° C.). Data acquisition began when the test probe temperature of the aqueous quenching medium reached about 1562° F. (849° C.) and was acquired for about 60 seconds, i.e., until the temperature reached about 300° F.

After data collection, cooling curves were obtained using the data collected using the various polymer mixtures. Cooling times were determined from the cooling curves during which the test specimens were cooled from 1562° F. (849° C.) to less than 203° F. (95° C.).

The data obtained is set forth in Table 1 below.

TABLE 1

| Run | Concentration (weight %) | Concentration of Compound I | II | III | IV | Cooling Time (sec) 1562-300° F. | Cooling Time (sec) 1562-500° F. |
|---|---|---|---|---|---|---|---|
| 1 | 0.80 | 100 | | | | 14 | 8 |
| 2 | 1.00 | | 100 | | | 12 | 8.5 |
| 3 | 0.85 | 75 | 25 | | | 12 | 8.5 |
| 4 | 0.90 | 50 | 50 | | | 14 | 9 |
| 5 | 0.95 | 25 | 75 | | | 14 | 10 |
| 6 | 0.80 | 100 | | | | 14 | 8 |
| 7 | 4.00 | | | 100 | | 15 | 8 |
| 8 | 1.60 | 75 | | 25 | | 24 | 10 |
| 9 | 2.40 | 50 | | 50 | | 27 | 14 |
| 10 | 3.20 | 25 | | 75 | | 24 | 10 |
| 11 | 0.80 | 100 | | | | 14 | 8 |
| 12 | 1.00 | | | | 100 | 25 | 12 |
| 13 | 0.85 | 75 | | | 25 | 25 | 13 |
| 14 | 0.90 | 50 | | | 50 | 32 | 17 |
| 15 | 0.95 | 25 | | | 75 | 35 | 20 |

The data illustrate that varying the quenching medium significantly increased cooling time when compared to each component in the quench medium. The data also illustrate that the reduced concentration of the combined polymers in the quenching medium did not significantly affect the cooling time of the metal substrate as compared to the individual polymers.

All publications cited in this specification are incorporated herein by reference. While the invention has been described with reference to particular embodiments, it will be appreciated that modifications can be made without departing from the spirit of the invention. Such modifications are intended to fall within the scope of the appended claims.

What is claimed is:

1. A quenching concentrate for heat-treating metal substrates, said concentrate comprising;

(a) about 5 to about 20% by weight of a composition comprising:

(i) a non-ionic, water-soluble or water-dispersible polyvinylpyrrolidone/polyvinylcaprolactam copolymer; and (ii) a non-ionic, water-soluble or water-dispersible polymer comprising a poly(oxyethyleneoxyalkylene) glycol polymer; and (b) about 80 to about 95% by weight water.

2. The concentrate according to claim 1, wherein component (i) is of formula I:

(I)

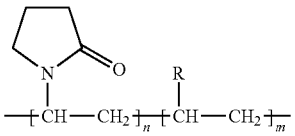

wherein:

R is a caprolactam;

n and m are, independently, integers, provided that said polymer of component (i) has a molecular weight of about 5,000 to about 2,000,000 and a K-value of about 60 to about 70.

3. The concentrate according to claim 2, said copolymer (i) comprising about 75% of n and about 25% of m.

4. The concentrate according to claim 1, wherein said polyvinylpyrrolidone/polyvinylcaprolactam copolymer (i) has a molecular weight of about 50,000 to about 1,000,000.

5. The concentrate according to claim 1, wherein component (ii) is of formula III:

(III)

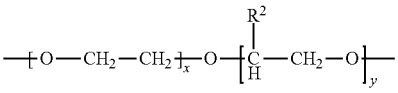

wherein:

$R^2$ is a chemical moiety that maintains the water solubility of said polymer (b);

x and y are integers, provided that said polymer (b) is water-soluble and said polyoxyethylene/polyoxyalkylene polymer has a molecular weight of about 1,000 to about 500,000.

6. The concentrate according to claim 5, wherein $R^2$ is an alkyl, substituted alkyl, alkenyl, substituted alkenyl, alkynyl, or substituted alkynyl.

7. The concentrate according to claim 1, further comprising one or more of a bacteriocidal agent, preservative, corrosion inhibitor, buffer, metal deactivator, and defoamer.

8. The concentrate according to claim 1, wherein the ratio of component (i) to component (ii) is about 90:10 to about 10:90.

9. The concentrate according to claim 1, comprising:

(i) a vinylpyrrolidone/vinylcaprolactam copolymer having a molecular weight of about 50,000 to about 1,000,000; and (ii) a polyoxyethylene/polyoxyalkylene copolymer having a molecular weight of about 1,000 to about 500,000.

10. The concentrate according to claim 1 comprising:

(i) a vinylpyrrolidone/vinylcaprolactam copolymer having a molecular weight of about 100,000 to about 200,000; and (ii) a polyoxyethylene/polyoxyalkylene copolymer having a molecular weight of about 5,000 to about 100,000.

11. A concentrate for preparing an aqueous quenching medium useful in the heat treatment of metal substrates, said concentrate comprising:

(a) about 5% to about 20% by weight of a mixture of:

(i) a nonionic, water-soluble or water-dispersible substituted vinylpyrrolidone/vinylcaprolactam polymer of formula I:

(I)

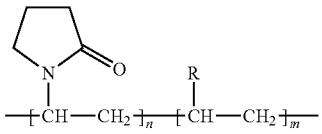

wherein:

R is a caprolactam;

n and m are independently integers, provided that said polymer of component (i) has a molecular weight of from about 5,000 to about 1,000,000 and a K-value of about 60 to about 70; and wherein said vinylpyrrolidone/vinylcaprolactam copolymer has a vinylpyrrolidone component of about 10 to about 90 mol%, said copolymer has a vinylcaprolactam component of about 90 to about 10 mol%, and the sum of said vinylpyrrolidone and vinylcaprolactam components is 100 mol%; and (ii) a polyoxyethylene/polyoxyalkylene polymer having formula III:

(III)

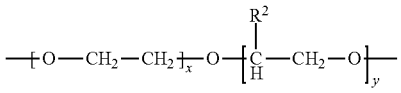

wherein:

$R^2$ is an alkyl, substituted alkyl, alkenyl, substituted alkenyl, alkynyl, or substituted alkynyl;

x and y are integers, provided that said polymer (b) is water-soluble and said polyoxyethylene/polyoxyalkylene polymer has a molecular weight of about 1,000 to about 500,000; and (b) about 80 to about 95% by weight water.

12. The concentrate according to claim 11, wherein said vinylpyrrolidone/vinylcaprolactam copolymer has a molecular weight of about 50,000 to about 1,000,000.

13. A method for quenching a heated metal substrate, said method comprising:

I. mixing the concentrate of claim 1 with a carrier, water, or a combination thereof; and II. quenching said heated metal substrate with the product of step I.

* * * * *